US006080484A

United States Patent [19]

Ujiie et al.

[11] Patent Number: 6,080,484

[45] Date of Patent: Jun. 27, 2000

[54] HEAT SENSITIVE STENCIL SHEET

[75] Inventors: Mitsuru Ujiie; Hirohide Hashimoto; Gen Totsuka, all of Ibaraki-ken, Japan

[73] Assignee: Riso Kagaku Corporation, Tokyo, Japan

[21] Appl. No.: 09/061,103

[22] Filed: Apr. 16, 1998

[30] Foreign Application Priority Data

Apr. 17, 1997 [JP] Japan ..... 9-116430

[51] Int. Cl.[7] ..... D02G 3/00

[52] U.S. Cl. ..... 428/401; 428/195; 428/364; 428/397; 428/400; 428/409

[58] Field of Search ..... 428/195, 364, 428/397, 400, 401, 409

[56] References Cited

FOREIGN PATENT DOCUMENTS 208 618 1/1987 European Pat. Off. .

311 687 4/1989 European Pat. Off. .

09048183 2/1997 Japan .

OTHER PUBLICATIONS

Patent Abstracts of Japan, vol. 097, No. 006, Jun. 30, 1997 & JP 09 048183 A 18 Feb. 1997.

*Primary Examiner*—Merrick Dixon

*Attorney, Agent, or Firm*—Pillsbury Madison & Sutro LLP

[57] ABSTRACT

Provided is a heat-sensitive stencil sheet comprising an ink-impermeable thermoplastic film and a porous substrate laminated to the film, characterized in that the porous substrate is a screen gauze which is made of synthetic fibers having a fiber diameter of 25–60 $\mu$m and has a mesh number of 160–190 or 210–290. The screen gauze may be subjected to calendering.

2 Claims, No Drawings

HEAT SENSITIVE STENCIL SHEET

FIELD OF THE INVENTION

The present invention relates to a heat-sensitive stencil sheet, especially a heat-sensitive stencil sheet which can be perforated to make a master by a thermal head, namely a thermal printing head.

BACKGROUND TO THE INVENTION

Known heat-sensitive stencil sheets used for stencil printing include those which comprise a thermoplastic film such as a polyester film, a polyvinylidene chloride film, or a polypropylene film and a porous substrate comprising a tissue paper or a nonwoven fabric mainly composed of natural fibers or synthetic fibers. The thermoplastic film and the substrate are laminated together using an adhesive.

However, these conventional heat-sensitive stencil sheets have not necessarily been satisfactory in sharpness of printed images and printing endurance. Various reasons for the insufficient sharpness of images can be considered, and one of them is a problem caused by a state of dispersion of fibers constituting the substrate. That is, since conventionally used tissue papers composed of natural fibers, synthetic fibers or mixtures thereof are partially non-uniform in dispersion of fibers, permeation of ink is apt to become uneven, and, particularly, permeation of ink is hindered by fibers aggregating on perforated portions of the film. As a result, defects such as blurring of prints and formation of white dots in solid printing occur in random or collectively. In order to solve these defects, it has been proposed to make the constituting fibers finer or reduce the basis weight of the fibers as much as possible.

The sharpness of images can be improved to some extent by employing finer fibers or reducing the basis weight of fibers of the substrate, but there are problems such as deterioration of strength and rigidity of stencil sheets. If the strength of stencil sheets is low, there occur such phenomena that stencil sheets are torn or stretched during printing, causing shift of printing position with increase of the number of printed copies. Moreover, if the rigidity of a stencil sheet deteriorates, the printing machine is jammed with the stencil sheet which is being carried in the printing machine or wrinkling of the stencil sheet occurs when the stencil sheet is wound around a printing drum, which causes deterioration of print quality.

One way to solve these defects is use of a screen gauze as the substrate. In the case of using the screen gauze, problem such as the above-mentioned formation of white dots do not occur and, besides, the stencil sheet is excellent in strength and rigidity because fibers are regularly arranged in the screen gauze.

However, due to the regular arrangement of fibers in the substrate, when the heat-sensitive stencil sheet is perforated by a thermal head, it rather interferes with regular heat generation pattern of the thermal head to cause formation of moire in printed images.

For the prevention of the moire, JP-A-9-48183 proposes to use a screen gauze comprising regular or irregular arrangement of a plurality of regions having different mesh number as a porous substrate of heat-sensitive stencil sheets. However, production of such screen gauze having a plurality of regions differing in the mesh number requires much labor. Furthermore, since percentage of aperture or fiber diameter of the substrate is different in every region differing in the mesh number, amount of ink passing through every region differs at the time of printing, and, therefore, transfer of the ink becomes uneven on the whole printed surface.

SUMMARY OF THE INVENTION

The object of the present invention is to solve the problems of conventional screen gauze and provide a heat-sensitive stencil sheet which is free from defects such as formation of white dots and occurrence of moire, gives sharp and clear print images, is superior in running characteristics in printing machines, and is high in printing endurance.

As a result of intensive researches conducted by the inventors to attain the above object, it has been found that the defects seen in conventional stencil sheets can be removed when the screen gauze composed of synthetic fibers having a specific fiber diameter has a mesh number within a specific range. Thus, the present invention has been accomplished.

That is, the present invention provides a heat-sensitive stencil sheet comprising an ink-impermeable thermoplastic film and a porous substrate laminated thereon, said porous substrate being a screen gauze made of synthetic fibers having a fiber diameter of 25–60 $\mu$m and having a mesh number of 160–190 or 210–290.

The heat-sensitive stencil sheet of the present invention can produce print images which are clear and free from moire even when it is perforated using any of thermal heads of 300 dpi, 400 dpi and 600 dpi in resolution.

DETAILED DESCRIPTION OF THE INVENTION

The screen gauze used in the present invention may be one which is substantially not perforated with heating by a thermal head and is permeable to an ink in printing. There may be used a gauze made of fibers such as of a polyester, a nylon, a rayon, a stainless steel, a silk, a cotton, and the like. The screen gauze may be subjected to calendering. The calendering treatment improves smoothness of the screen gauze and thus improves smoothness of the surface of the thermoplastic film of the stencil sheet. The calendering treatment can further prevent deterioration in smoothness of the surface of the film caused by the pressure applied between the upper and back sides of a stencil sheet when the stencil sheet is made into a roll. When the surface on the film side of the stencil sheet is high in smoothness, substantially no failure in perforation occurs because of close contact between the film and the thermal head, and uniform print images can be obtained.

In the present invention, the mesh number of the screen gauze, namely the number of fibers or yarn per 1 inch, is 160–190 or 210–290, and the mesh number in lengthwise direction and that in crosswise direction may be the same or different as long as it is within the above-mentioned range. If the mesh number of the screen gauze is about 200, the resulting image is sharp, but interferes with a pitch of perforations formed by a thermal head, causing formation of much moire. If the mesh number is less than 160 and particularly about 150, moire is formed by a thermal head of 300 dpi or 600 dpi, and even in the case of the mesh number where no moire is formed, too much ink passes therethrough, causing spread of inks and blotted images. If the mesh number is more than 290 and particularly about 300, moire is formed by a thermal head of 300 dpi or 600 dpi, and if the mesh number is further greater, passage of ink is unsatisfactory, resulting in blurred or unclear images. Furthermore, since productivity of screen gauze lowers, it becomes very expensive and costly to manufacture stencil sheets.

In the present invention, fiber diameter of the fibers constituting the screen gauze is 25–60 μm. If the fiber diameter is less than 25 μm, fibers are readily broken and weaving efficiency is inferior. Furthermore, strength of stencil sheets decreases, and images are sometimes extended or distorted during printing. If the fiber diameter is more than 60 μm, an area where the perforated portions of the thermoplastic film are covered by yarn of the screen gauze increases, causing deterioration of passage of inks and making print images blurred or unclear.

The heat-sensitive stencil sheet of the present invention can be produced by laminating the screen gauze on a thermoplastic film using adhesives and the like.

The thermoplastic films may be those which can be perforated with heating by a thermal head, and examples of the films are a polyester film, a polyester copolymer film, a polyvinyl chloride film, a vinyl chloride-vinylidene chloride copolymer film, a polypropylene film, and the like. Thickness of the film is preferably about 0.5–9.0 μm.

The adhesives may be those which can bond the thermoplastic film and the screen gauze, and examples of them are a vinyl acetate resin, a vinyl chloride-vinyl acetate copolymer resin, a polyester resin, an urethane resin, an acrylic resin, a polyvinyl alcohol resin, and the like. If necessary, other additives such as an antistatic agent, a lubricant, and the like may be added to the adhesives. Coating amount of the adhesives may be such that substantially no problems is caused in strength after bonding the thermoplastic film and the screen gauze, and it is preferably 2 g/m$^2$ or less, more preferably 0.2–1.8 g/m$^2$.

In order to prevent heat fusion of the heat-sensitive stencil sheet, there may be provided an anti-sticking layer on the thermoplastic film. The anti-sticking agents used may be compounds having release properties, such as surface active agents, various waxes, silicone or fluorine type compounds, and the like. Furthermore, if necessary, other additives such as an antistatic agent, a lubricant, and the like may be added to the anti-sticking agents.

The following nonlimiting examples will explain the present invention in more detail.

EXAMPLE 1

A heat-shrinkable polyester film of 2.0 μm in thickness and a screen gauze of 180 mesh comprising polyester fibers of 45 μm in fiber diameter were bonded using a vinyl acetate adhesive in an amount of 0.5 g/m$^2$ in terms of nonvolatile matter. Furthermore, 0.1 g/m$^2$ of a silicone-based releasing agent was coated as an anti-sticking layer on the heat-shrinkable polyester film to obtain a heat-sensitive stencil sheet.

The resulting heat-sensitive stencil sheet was perforated by thermal heads of 300 dpi, 400 dpi and 600 dpi in resolution, and then wound around a printing drum of a rotary stencil printing apparatus RISOGRAPH (registered trademark) SR7200 (manufactured by RISO KAGAKU CORPORATION) to carry out stencil printing. The resulting print images were visually evaluated on formation of moire and sharpness of prints. The results are shown in Table 1.

EXAMPLE 2

A heat-sensitive stencil sheet was obtained in the same manner as in Example 1, except that the polyester screen gauze had a fiber diameter of 40 μm and a mesh number of 255. The print images were evaluated in the same manner as in Example 1. The results are shown in Table 1.

COMPARATIVE EXAMPLE 1

A heat-sensitive stencil sheet was obtained in the same manner as in Example 1, except that the polyester screen gauze had a fiber diameter of 45 μm and a mesh number of 150. The print images were evaluated in the same manner as in Example 1. The results are shown in Table 1.

COMPARATIVE EXAMPLE 2

A heat-sensitive stencil sheet was obtained in the same manner as in Example 1, except that the polyester screen gauze had a fiber diameter of 45 μm and a mesh number of 200. The print images were evaluated in the same manner as in Example 1. The results are shown in Table 1.

COMPARATIVE EXAMPLE 3

A heat-sensitive stencil sheet was obtained in the same manner as in Example 1, except that the polyester screen gauze had a fiber diameter of 65 μm and a mesh number of 180. The print images were evaluated in the same manner as in Example 1. The results are shown in Table 1.

TABLE 1

| | Mesh number | Fiber diameter (μm) | Sharpness 300 dpi | Sharpness 400 dpi | Sharpness 600 dpi | Moire 300 dpi | Moire 400 dpi | Moire 600 dpi |
|---|---|---|---|---|---|---|---|---|
| Example 1 | 180 | 45 | ○ | ○ | ○ | − | − | − |
| Example 2 | 255 | 40 | ○ | ○ | ○ | − | − | − |
| Comparative Example 1 | 150 | 45 | Δ | Δ | Δ | + | − | + |
| Comparative Example 2 | 200 | 45 | ○ | ○ | ○ | + | + | + |
| Comparative Example 3 | 180 | 65 | x | x | x | − | − | − |

Notes)
○: Neither spreading nor blurring occurred.
Δ: Spreading occurred.
x: Blurring occurred.
−: No moire was formed.
+: Moire was formed.

As can be seen from Table 1, sharp images can be obtained by using a screen gauze having a mesh number of 160–290 while much moire is formed when a screen gauze of 200 mesh is used (Comparative Example 2). When a screen gauze having a mesh number of less than 160 is used (Comparative Example 1) and a screen gauze having a fiber diameter of more than 60 μm is used (Comparative Example 3), sharpness of images deteriorates.

According to the present invention, a screen gauze having a mesh number within a specific range is used, and, hence, the mesh pitch of the screen gauze does not interfere with the perforation pitch of the thermal head, and no moire occurs even in solid printing or halftone printing.

Furthermore, since a screen gauze having a fiber diameter within a specific range is used, there is no problem in weaving, which is caused when too thin fibers are used, and non-perforation area produced due to overlapping of perforated portions of a stencil sheet and yarn of the screen gauze can be decreased. Thus, uniform images can be obtained even in solid printing and halftone printing.

Moreover, when the screen gauze of the present invention having a mesh number within a specific range and a fiber diameter within a specific range is used, the stencil sheet is neither torn nor elongated during printing. Thus, stable print quality is obtained, printing endurance is superior, and the printing apparatus is not jammed with a stencil sheet or wrinkling does not occur on a stencil sheet while the sheet is conveyed in the printing apparatus.

What we claim is:

1. A heat-sensitive stencil sheet comprising an ink-impermeable thermoplastic film and a porous substrate laminated to the film, characterized in that the porous substrate is a screen gauze which is made of synthetic fibers having a fiber diameter of 25–60 $\mu$m and has a mesh number of 160–190 or 210–290.

2. A heat-sensitive stencil sheet according to claim 1, wherein the screen gauze is subjected to calendering.

* * * * *